US005321872A

United States Patent [19]

Merser

[11] Patent Number: 5,321,872

[45] Date of Patent: Jun. 21, 1994

[54] TAMPER-RESISTANT PLASTIC FASTENER FOR USE IN ATTACHING A TAG TO A PIECE OF FABRIC

[75] Inventor: F. Gerard Merser, Round Pond, Me.

[73] Assignee: Avery Dennison Corporation, Pasadena, Calif.

[21] Appl. No.: 947,532

[22] Filed: Sep. 21, 1992

[51] Int. Cl.[5] ..... G09F 3/12

[52] U.S. Cl. ..... 24/704.1; 24/711.1; 206/338; 206/343

[58] Field of Search ..... 24/711.1, 704.1, 72.7; 206/340, 343, 346, 348, 338

[56] References Cited

U.S. PATENT DOCUMENTS 3,686,717 8/1972 Merser ..... 24/711.1 X 3,850,297 11/1974 Merser ..... 24/711.1 X

*Primary Examiner*—James R. Brittain

*Attorney, Agent, or Firm*—Kriegsman & Kriegsman

[57] ABSTRACT

Tamper-resistant plastic fastener for use in attaching a tag to a piece of fabric, such as a garment of clothing, a product label or the like. In one embodiment, the fastener comprises an elongated unitary plastic member having a first end shaped to define a cross-bar, a second end shaped to define a paddle, and a flexible filament interconnecting the cross-bar and the paddle. The filament is shaped to include an enlarged portion, which is appropriately sized, shaped, and positioned to prevent a sufficient amount of the filament to be drawn through the fabric to permit the cross-bar to be easily aligned with the filament. Consequently, the cross-bar and the filament cannot easily be pushed back through the same opening in the piece of fabric through which they were originally inserted, making intact removal of the fastener from the piece of fabric extremely difficult.

8 Claims, 2 Drawing Sheets

TAMPER-RESISTANT PLASTIC FASTENER FOR USE IN ATTACHING A TAG TO A PIECE OF FABRIC

BACKGROUND OF THE INVENTION

The present invention relates generally to plastic fasteners of the type used to attach tags to pieces of fabric and more particularly to a plastic fastener of this type which, once attached to a piece of fabric, is difficult to remove therefrom intact.

Plastic fasteners of the type used to attach tags to pieces of fabric, such as articles of clothing, product labels, and the like, are well known in the art and widely used in the retail industry. Typically, such fasteners comprise an elongated plastic member having a first end shaped to define a cross-bar (also commonly referred to as a "T-bar"), a second end shaped to define a paddle, and a thin filament portion interconnecting the cross-bar and the paddle. The cross-bar is adapted to be inserted first through a tag and then into a desired piece of fabric; the paddle is appropriately sized and shaped to keep the tag from being pulled off the filament portion. Typically, such fasteners are mass-produced by a molding process in either one of two different forms known as fastener stock. One type of fastener stock, which is shown in commonly-assigned U.S. Pat. No. 3,103,666 and incorporated hereinto by reference, comprises a plurality of fasteners joined together at their respective cross-bars by an orthogonally disposed runner bar. The other type of fastener stock, which is shown in commonly-assigned U.S. Pat. No. 4,955,475 and incorporated hereinto by reference, comprises a plurality of fasteners arranged in an end-to-end alignment, the heads and opposite ends of successive fasteners being joined together by severable connectors so as to form a continuously connected fastener stock.

Typically, the cross-bar portion of a single fastener is separated from a quantity of fastener stock and then inserted through a tag and into a piece of fabric with a hand-held apparatus commonly referred to as a tagging gun. (Connections, if any, between the paddles of a pair of adjacent fasteners are severed by pulling the tagging gun away from the piece of fabric after the cross-bar of one of the fasteners has been inserted thereinto.) Examples of tagging guns are illustrated in commonly-assigned U.S. Pat. Nos. 5,024,365, 4,121,487, and 4,456,161, all of which are incorporated hereinto by reference.

While plastic fasteners of the type described above function well in their intended purpose, it is nonetheless known that certain unscrupulous consumers have, on occasion, engaged in "ticket-switching" wherein the tag from a low-priced item is switched with the tag from a high-priced item. As can readily be appreciated, "ticket-switching" requires that either the fastener holding the low-priced tag or the fastener holding the high-priced tag be removed intact from its respective item so that it can later be manually re-attached to the high-priced item with the low-priced tag. Typically, such removal of the plastic fastener is accomplished first by positioning the cross-bar so that it is parallel to the filament (i.e., by pulling on the cross-bar to create some slack in the filament and then bending the end of filament adjacent to the cross-bar so that the cross-bar is aligned with the remainder of the filament) and then by pushing the cross-bar and the filament back through the same opening in the piece of fabric through which they were originally inserted.

SUMMARY OF THE INVENTION

It is an object of the present invention to provide a new and improved plastic fastener of the type used to attach a tag to a piece of fabric.

It is another object of the present invention to provide a plastic fastener of the type described above which is more difficult to remove intact from a piece of fabric to which it is attached than are existing plastic fasteners.

It is still another object of the present invention to provide a plastic fastener of the type described above which preferably can be mass-produced according to conventional techniques to form fastener stock of either the continuously connected variety or the runner bar variety and which preferably can be dispensed using conventional tagging guns.

To achieve the purpose of the invention as broadly set forth above, a plastic fastener constructed according to the teachings of the present invention for use in attaching a tag to a piece of fabric is provided which comprises an elongated unitary plastic member having a first end, a second end, and a filament interconnecting said first end and said second end, said first end being shaped to define a cross-bar insertable through a tag and into a piece of fabric, said second end being shaped so as to prevent removal of a tag thereacross, said filament having an enlarged portion sized and shaped to limit the extent of insertion of said filament into a piece of fabric, said enlarged portion being appropriately spaced from said cross-bar so that, when said cross-bar is inserted into a piece of fabric, said cross-bar cannot easily be aligned with said filament in such a way as to permit said cross-bar and said filament to be removed from the piece of fabric.

In a preferred embodiment of the invention, the enlarged portion of the filament is disc-shaped, and the second end of the elongated unitary plastic member is paddle-shaped. Additionally, the cross-bar, the disc-shaped enlarged portion of the filament, and the paddle-shaped second end of the plastic member all preferably face in the same direction. Moreover, the distance between the disc-shaped enlarged portion of the filament and the cross-bar is preferably slightly less than one-half the length of the cross-bar.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
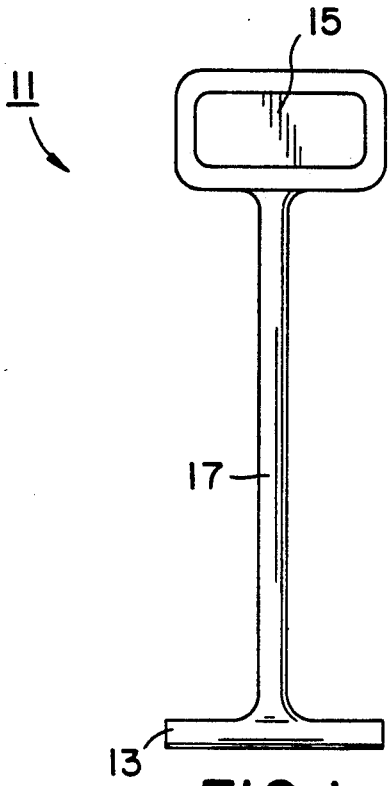
FIG. 1 PRIOR ART
FIG. 1 is a front view of a prior art plastic fastener for use in attaching a tag to a piece of fabric.

Referring now to FIG. 1, there is shown a prior art plastic fastener of the type used to attach a tag to a piece of fabric, the prior art plastic fastener being represented generally by reference numeral 11.

Fastener 11 is an elongated unitary plastic member having a first end which is shaped to define a cross-bar 13, a second end which is shaped to define a paddle 15, and a filament 17 which interconnects cross-bar 13 and paddle 15. Cross-bar 13 is appropriately sized and shaped to be inserted through a tag and into a piece of fabric, preferably through the hollow slotted needle of a tagging gun. Paddle 15 is appropriately sized and shaped to prevent a tag positioned on filament 17 from being removed thereover. As can readily be appreciated, fastener 11 may be molded as part of a quantity of either continuously connected fastener stock or fastener stock of the type having an orthogonally disposed runner bar.

Figure 2:
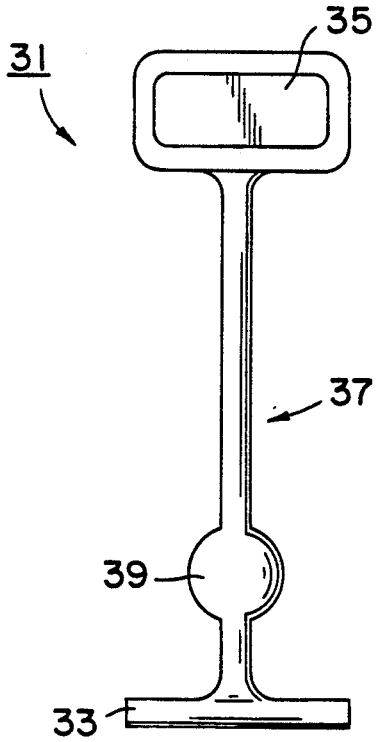
FIG. 2 is a front view of a plastic fastener constructed according to the teachings of the present invention for use in attaching a tag to a piece of fabric.
Figure 3:
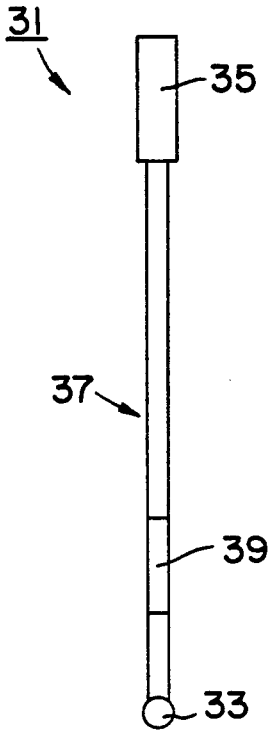
FIG. 3 is a right end view of the plastic fastener shown in FIG. 2.

Referring now to FIGS. 2 and 3, there is shown a plastic fastener constructed according to the teachings of the present invention for use in attaching a tag to a piece of fabric, the plastic fastener being represented generally by reference numeral 31.

As can readily be seen, plastic fastener 31 is very similar in construction and composition to plastic fastener 11, plastic fastener 31 also being an elongated unitary plastic member having a first end which is shaped to define a cross-bar 33, a second end which is shaped to define a paddle 35, and a filament 37 which interconnects cross-bar 33 and paddle 35. Plastic fastener 31, however, differs from plastic fastener 11 in that filament 37 includes an enlarged portion 39. In the embodiment shown, enlarged portion 39 is disc-shaped (as opposed to being spherical) and faces in the same direction as cross-bar 33 and paddle 35 so that several fasteners 31 can be joined together in a runner bar-type fastener stock manner, but it will readily be understood that enlarged portion 39 may take any shape(s) or form(s) consistent with the purpose hereinafter described.

Figure 4:
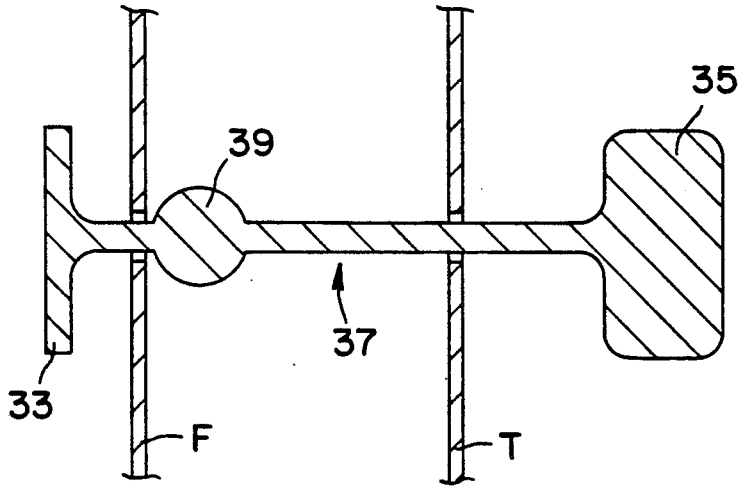
FIG. 4 is a section view illustrating how the enlarged portion of the filament of the plastic fastener of FIG. 2 makes it significantly more difficult for someone to align the cross-bar with the filament in such a way as to permit the cross-bar and the filament to be pushed back through the same opening in the piece of fabric through which they were originally inserted.

Referring now to FIG. 4, the manner in which enlarged portion 39 serves to prevent fastener 31 from being removed intact from a piece of fabric F is shown. For illustrative purposes, fastener 31 is shown holding a tag T.

As can be seen, because of the size, shape, and placement of enlarged portion 39, a sufficient amount of slack in filament 37 cannot be drawn through fabric F so as to permit cross-bar 33 to be aligned with filament 37. Consequently, intact removal of fastener 31 from fabric F is effectively prevented.

As can readily be appreciated, best results will typically be obtained when the distance between enlarged portion 39 and cross-bar 33 is slightly less than one-half the length of cross-bar 33. However, some variation from these values may occur due to the thickness of the fabric and/or the resiliency of cross-bar 33 and filament 39; therefore, in certain instances, the distance between enlarged portion 39 and cross-bar 33 may be equal to or greater than one-half the length of cross-bar 33.

Although the invention has been described with respect to plastic fasteners of the type for use in attaching tags to pieces of fabric, it should be understood that the principles of the invention may be applied generally to any plastic fastener of the type having an elongated filament and a cross-bar attached to at least one end of the elongated filament. Such plastic fasteners may include the well-known and commonly-used loop-type fasteners, which are fired twice from a tagging gun and are used to loosely pair items together, to hang soft goods or to secure products to packaging.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A plastic fastener for use in attaching a tag to a piece of fabric comprising an elongated unitary plastic member having a first end, a second end, and a filament interconnecting said first end and said second end, said first end being shaped to define a cross-bar insertable through a tag and into a piece of fabric, said second end being shaped so as to prevent removal of a tag thereacross, said filament having an enlarged portion sized and shaped to limit the extent of insertion of said filament into a piece of fabric, said enlarged portion being spaced from said cross-bar a distance of about one-half the length of said cross-bar so that when said cross-bar is inserted into a piece of fabric a sufficient length of filament cannot be drawn through said fabric to permit said cross-bar to be aligned with said filament for intact removal of said fastener from said piece of fabric.

2. The plastic fastener as claimed in claim 1 wherein said second end is shaped to define a paddle.

3. The plastic fastener as claimed in claim 1 wherein said enlarged portion is disc-shaped.

4. The plastic fastener as claimed in claim 3 wherein said second end is shaped to define a paddle.

5. The plastic fastener of claim 1 wherein said enlarged portion is at a distance slightly greater than one-half the length of the cross-bar.

6. The plastic fastener of claim 1 wherein said enlarged portion is at a distance slightly less than one-half the length of the cross-bar.

7. In a plastic fastener of the type used in attaching a tag to a piece of fabric, said plastic fastener comprising an elongated unitary plastic member having a first end, a second end, and a filament interconnecting said first end and said second end, said first end being shaped to define a cross-bar insertable through a tag and into a piece of fabric, said second end being shaped to define a paddle sized and shaped to prevent removal of a tag from said second end, the improvement comprising said filament having an enlarged portion sized and shaped to limit the extent of insertion of said filament into a piece of fabric, said enlarged portion being spaced from said cross-bar a distance of about one-half the length of said cross-bar.

8. In a plastic fastener of the type comprising an elongated unitary plastic member having a filament and a cross-bar attached to one end of said filament, said cross-bar being insertable through a sheet of material, the improvement comprising said filament having an enlarged portion sized and shaped to limit the extent of insertion of said filament into a sheet of material, said enlarged portion being spaced from said cross-bar a distance slightly less than of about one-half the length of said cross-bar so that when said cross-bar is inserted into a sheet of material a sufficient length of filament cannot be drawn through said sheet of material to permit said cross-bar to be aligned with said filament to enable easy removal of said filament and cross-bar from said sheet of material.

* * * * *